US007400846B2

(12) United States Patent
Takamatsu

(10) Patent No.: US 7,400,846 B2
(45) Date of Patent: Jul. 15, 2008

(54) IMAGE FORMING APPARATUS HAVING GUIDE SUPPORTING BRACKETS INCLUDING PAPER TRANSPORTATION GUIDES

(75) Inventor: Naritoshi Takamatsu, Nara (JP)

(73) Assignee: Murata Machinery, Ltd., Kyoto (JP)

( * ) Notice: Subject to any disclaimer, the term of this patent is extended or adjusted under 35 U.S.C. 154(b) by 204 days.

(21) Appl. No.: 11/278,156

(22) Filed: Mar. 31, 2006

(65) Prior Publication Data

US 2006/0222403 A1 Oct. 5, 2006

(30) Foreign Application Priority Data

Apr. 5, 2005 (JP) ..... 2005-108738

(51) Int. Cl.
*G03G 15/00* (2006.01)

(52) U.S. Cl. ..... 399/116; 399/388

(58) Field of Classification Search ..... 399/116, 399/117, 121, 388
See application file for complete search history.

(56) References Cited

U.S. PATENT DOCUMENTS 4,168,902 A * 9/1979 Golz ..... 399/399

FOREIGN PATENT DOCUMENTS

JP 05-002346 1/1993
JP 05297649 A * 11/1993
JP 06-317995 11/1994

* cited by examiner

*Primary Examiner*—Ryan Gleitz
(74) *Attorney, Agent, or Firm*—Keating & Bennett, LLP

(57) ABSTRACT

An image forming apparatus includes an apparatus main body, a photoconductive drum, a transfer roller, a pair of guide supporting brackets, and an urging member. The guide supporting brackets include two paper transportation guides, and the brackets are mounted on both end portions of a drum shaft of the photoconductive drum in a manner capable of being swung about the drum shaft as a center. The paper transportation guides are arranged laterally at a predetermined interval therebetween on the guide supporting brackets. The urging member is provided in the apparatus main body. In a state in which the photoconductive drum is installed in the apparatus main body, swinging ends of the guide supporting brackets are pressed against the transfer roller by the urging member, and the paper transportation guides are positioned at a predetermined position in proximity of an upstream side of the nip portion in a paper transportation direction.

16 Claims, 6 Drawing Sheets

IMAGE FORMING APPARATUS HAVING GUIDE SUPPORTING BRACKETS INCLUDING PAPER TRANSPORTATION GUIDES

BACKGROUND OF THE INVENTION

1. Field of the Invention

The present invention relates to an image forming apparatus provided in a facsimile machine, a copy machine, or a printer machine (or a Multi Function Peripheral (MFP) of these machines). In particular, the present invention relates to an image forming apparatus using a contact and transfer method and including an electrophotographic printer unit having a photoconductive drum and a transfer roller, which rotate while making contact with one another, wherein paper is introduced into a contact portion between the photoconductive drum and the transfer roller and a toner image is transferred onto the paper.

2. Description of the Related Art

In an electrophotographic printer unit, an electrostatic latent image is formed on a surface of a photoconductive drum. A developing device develops the electrostatic latent image to form a toner image. Then, paper, which has been introduced in synchronism with forming the toner image, is nipped in a nip portion between the photoconductive drum and a transfer roller, and the toner image is transferred onto the paper. A paper transportation guide is arranged at a position located upstream of the nip portion in a paper transportation direction and in proximity of the nip portion. Thus, a leading edge of the paper is introduced accurately into the nip portion. In this case, when the leading edge of the paper, which is guided by the paper transportation guide, hits the transfer roller first, toner on the surface of the photoconductive drum may scatter due to an electric field between the photoconductive drum and the transfer roller. Therefore, the paper transportation guide is positioned appropriately so that the leading edge of the paper hits the surface of the photoconductive drum first and then the paper is introduced into and nipped by the nip portion accompanying the rotation of the photoconductive drum.

In a first conventional apparatus, a paper transportation guide is fixed on an apparatus main body or mounted integrally on a cover, which is opened and closed for removing jammed paper. In a second conventional apparatus, to prevent toner from scattering, a paper transportation guide guides paper to a position located in proximity of a nip portion. In addition, to maintain ease of maintenance work performed when removing and inserting a transfer roller to replace the transfer roller, the paper transportation guide is held removably with respect to a positioning member of the photoconductive drum.

However, as described above, when the paper transportation guide is fixed on the apparatus main body, or when the paper transportation guide is mounted integrally on the cover, the removable photoconductive drum or a drum unit (process unit) and the transfer roller are not precisely positioned with respect to the paper transportation guide. Therefore, the scattering of the toner resulting from a position where the paper is introduced as described above is not sufficiently prevented. In the second conventional apparatus, although the paper transportation guide is held removably with respect to the positioning member of the photoconductive drum, the paper transportation guide is not positioned directly with respect to the photoconductive drum. In the same manner, the paper transportation guide is not positioned directly with respect to the transfer roller. Therefore, a relative positional relationship of the photoconductive drum, the transfer roller, and the paper transportation guide is difficult to be appropriately set. Thus, to maintain a high printing (recording) precision, an improvement is desired.

SUMMARY OF THE INVENTION

In order to overcome the problems described above, preferred embodiments of the present invention enable forming a high quality image by appropriately maintaining a relative positional relationship of a photoconductive drum, a transfer roller, and a paper transportation guide.

According to a preferred embodiment of the present invention, an image forming apparatus includes an electrophotographic printer unit wherein the printer unit includes a photoconductive drum and a transfer roller. The transfer roller makes contact with the photoconductive drum. A toner image on a surface of the photoconductive drum is transferred onto paper which has been introduced into a nip portion between the transfer roller and the photoconductive drum. A pair of guide supporting brackets are mounted on both end portions of a drum shaft of the photoconductive drum in a manner capable of swinging about the drum shaft as a center. Two paper transportation guide plates are arranged laterally with a predetermined interval therebetween on the pair of the guide supporting brackets. In a state in which the photoconductive drum is installed in an apparatus main body, an urging member in the apparatus main body presses a swinging end of the guide supporting brackets against a shaft portion of the transfer roller. Accordingly, the two paper transportation guide plates are located at a predetermined position upstream of the nip portion between the photoconductive drum and the transfer roller in a paper transportation direction and in proximity of the nip portion.

According to another preferred embodiment of the present invention, in a state in which the photoconductive drum is installed in the apparatus main body, the swinging end of the guide supporting brackets may be pressed against a stopping portion in the apparatus main body. According to another preferred embodiment of the present invention, in a paper transportation direction, a downstream end portion of the paper transportation guide plate located closer to the transfer roller is preferably positioned closer to the nip portion between the photoconductive drum and the transfer roller than a downstream end portion of the paper transportation guide plate located closer to the photoconductive drum.

According to the above-described image forming apparatus, the guide supporting brackets are respectively mounted on both end portions of the drum shaft of the photoconductive drum. In a state in which the photoconductive drum is installed in the apparatus main body, the swinging ends of the guide supporting brackets are pressed against the shaft portion of the transfer roller by the urging member in the apparatus main body. Thus, a relative position of the two paper transportation guide plates with respect to the drum shaft of the photoconductive drum and the shaft portion of the transfer roller is always constant. Therefore, if a fixed position of the paper transportation guide plates with respect to the guide supporting brackets is set, a positional relationship of the paper transportation guide plates with respect to the photoconductive drum and the transfer roller is also directly set. Accordingly, the paper is introduced with an extremely high precision into the nip portion between the photoconductive drum and the transfer roller.

According to the above-described preferred embodiment of the present invention, in a state in which the photoconductive drum is installed in the apparatus main body, the swinging ends of the guide supporting brackets are pressed against the stopping portion in the apparatus main body. Thus, the positioning of the guide supporting brackets in the apparatus main body is carried out by the shaft portion of the transfer roller and the stopping portion. Therefore, an even more stable positioned state is maintained. Furthermore, if the positional relationship of the downstream end of the two paper transportation guide plates in the paper transportation direction is set as described above, in addition to the highly precise positioning described above, the paper is introduced extremely accurately into the nip portion between the photoconductive drum and the transfer roller. In particular, scattering of the toner resulting from the contact of the leading edge of the paper with the transfer roller does not occur. As a result, an image forming process can be carried out with a high image quality.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
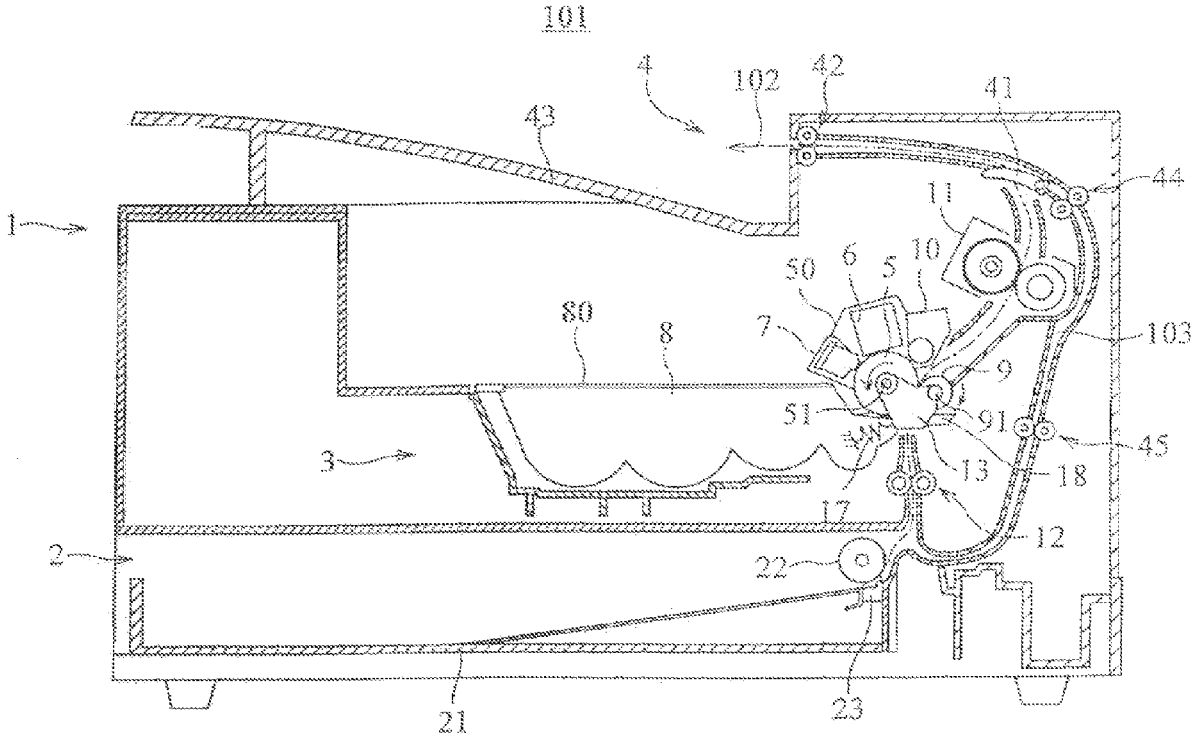
FIG. 1 is a vertical sectional view illustrating an example of an image forming apparatus according to a preferred embodiment of the present invention.

With reference to the drawings, a description will be made of preferred embodiments of the present invention. FIG. 1 illustrates an image forming apparatus 101 as an example of a printer including an electrophotographic printer unit. The present invention is not limited to such an example and may be a copy machine, a facsimile machine, or an MFP including an image scanning apparatus. In an apparatus main body 1 of the image forming apparatus 101, a paper feeding unit 2 for feeding printing paper, an electrophotographic printer unit 3, and an output unit 4 are stacked in this order in a vertical direction. Printed printing paper is output onto the output unit 4. The paper feeding unit 2 includes a paper feed cassette 21, a paper separating and feeding roller 22, and a separating pad 23. The paper feed cassette 21 can accommodate a plurality of printing papers in a stacked state. The paper feed cassette 21 can be inserted and removed. The paper separating and feeding roller 22 is arranged at a front end of the paper feed cassette 21. The separating pad 23 elastically makes contact with a circumferential surface of the paper separating and feeding roller 22.

The printer unit 3 includes a process unit and a fixing device 11 arranged downstream of the process unit. The process unit includes a charging device 6, an exposing device 7 including a Light Emitting Diode (LED) or the like, a developing device 8, a transfer roller 9, and a foreign particle removing cleaner 10 arranged in this order around a photoconductive drum 5. The photoconductive drum 5, the charging device 6, and the foreign particle removing cleaner 10 of the process unit are mounted on a drum casing 50 and are unitized as a drum unit. The developing device 8 includes a developing device casing 80, a developing roller, and an agitating member or the like and is unitized as a developing unit. The developing device casing 80 functions also as a toner container. The developing roller and the agitating member or the like are mounted on the developing device casing 80. The drum casing (hereinafter also referred to as a "drum unit") 50 and the developing device casing (hereinafter also referred to as a "developing unit") 80 are capable of being individually inserted and removed in a direction perpendicular to the page of FIG. 1. In the example illustrated in FIG. 1, the transfer roller 9 is installed rotatably in the apparatus main body 1. However, the transfer roller 9 may be arranged rotatably on a cover (not illustrated) that can be opened and closed for removing jammed paper. The drum unit 50 and the developing unit 80 maybe an integral process unit. Alternatively, when the drum unit 50 and the developing unit 80 are capable of being inserted and removed as described above, the drum unit 50 and the developing unit 80 may be removed from an upper side of the apparatus main body 1.

A switching gate 41, an output roller pair 42, and an output tray 43 are arranged downstream of the fixing device 11. The switching gate 41, the output roller pair 42, and the output tray 43 define the output unit 4. A resist roller pair 12 is arranged in proximity of an upstream side of the process unit. The resist roller pair 12 corrects a skew of printing papers separated one sheet at a time and fed from the paper feed cassette 21 by the paper separating and feeding roller 22 and the separating pad 23. After the skew has been corrected, the printing paper is introduced into a nip portion 104 (refer to FIG. 2) between the photoconductive drum 5 and the transfer roller 9. While the photoconductive drum 5 is rotating in a direction indicated by an arrow in FIG. 1, a surface of the photoconductive drum 5 is uniformly positively charged by the charging device 6. An optical image based on image information is irradiated on the surface of the photoconductive drum 5 by the exposing device 7, and an electrostatic latent image is formed on the surface of the photoconductive drum 5. The electrostatic latent image is developed sequentially by the developing device 8. A toner image reaches the nip portion 104 between the photoconductive drum 5 and the transfer roller 9 accompanying the rotation of the photoconductive drum 5. The resist roller pair 12 is controlled and rotated so that the printing paper is introduced into the nip portion 104 in synchronism with the toner image formed on the surface of the photoconductive drum 5.

The transfer roller 9 makes contact with the photoconductive drum 5. The transfer roller 9 nips and transports the printing paper while rotating in a direction indicated by an arrow. Since a bias voltage is applied to the transfer roller 9, the toner image on the surface of the photoconductive drum 5 is transferred onto the printing paper during this period of time. The printing paper, on which the toner image has been transferred, is introduced into the fixing device 11 and the toner image is fixed as a permanent image. Then, the printing paper pushes up the switching gate 41 and is output onto the output tray 43 via the output roller pair 42. A series of printing paper transportation operations is carried out along a paper feeding path 102 (illustrated by an alternate short and long dash line in FIG. 1). The paper feeding path 102 extends from the paper feed cassette 21. Immediately after the paper feeding path 102 extends from the paper feed cassette 21, the paper feeding path 102 rises substantially perpendicularly. Then, the paper feeding path 102 makes a turn so that the paper feeding path 102 at the output roller pair 42 is facing approximately 180 degrees in an opposite direction from a direction in which the paper feeding path 102 extends from the paper feed cassette 21.

The image forming apparatus 101 of FIG. 1 is capable of carrying out a duplex printing operation. The image forming apparatus 101 includes a reversal path 103. The reversal path 103 starts from a mounting position of the switching gate 41 of the paper feeding path 102 and rejoins the paper feeding path 102 at a position upstream of the resist roller pair 12. The output roller pair 42 can rotate in both directions. Transportation roller pairs 44 and 45 are arranged on the reversal path 103. A description will be made of a procedure performed in the duplex printing operation. After the printing operation has been performed on a first side of the printing paper as described above, the printing paper is transported along the paper feeding path 102. When a trailing edge of the printing paper reaches the output roller pair 42, the output roller pair 42 stops once and nips the trailing edge of the printing paper. Next, the output roller pair 42 rotates in a reverse direction, and the printing paper is transported along the reversal path 103 by the transportation roller pairs 44 and 45 by its trailing edge. Then, the printing paper reaches the resist roller pair 12, and the skew of the printing paper is corrected by the resist roller pair 12. The printing paper is introduced into the nip portion 104 between the photoconductive drum 5 and the transfer roller 9 again, and a printing operation is performed on a reverse side of the printing paper. After the printing operation has been performed on both sides of the printing paper, the printing paper is transported along the paper feeding path 102 and output onto the output tray 43.

A drum shaft 51 of the photoconductive drum 5 is fixed on the drum casing 50. The photoconductive drum 5 is supported rotatably on the drum shaft 51. The end portions of the drum shaft 51 protrude from both sides of the drum casing 50. A pair of parallel guide supporting brackets 13 and 13 are mounted on both end portions of the drum shaft 51 in a manner capable of being swung vertically about the drum shaft 51 as a center. Two paper transportation guide plates 14 and 15 are arranged laterally at a predetermined interval between the guide supporting brackets 13 and 13. The leading edge of the printing paper, of which the skew has been corrected by the resist roller pair 12, is guided by the paper transportation guide plates 14 and 15 and introduced accurately into the nip portion 104 between the photoconductive drum 5 and the transfer roller 9.

A paper pass-through gap 16 is set at a predetermined interval between the paper transportation guide plates 14 and 15. In a state in which the paper pass-through gap 16 is positioned, the paper pass-through gap 16 is arranged at a position located slightly closer to the photoconductive drum 5 in a plan view. In the paper transportation direction, a downstream end portion 151 of the paper transportation guide plate 15 closer to the transfer roller 9 is located closer to the nip portion 104 than a downstream end portion 141 of the paper transportation guide plate 14 closer to the photoconductive drum 5. Accordingly, the leading edge of the paper transported through the paper pass-through gap 16 makes contact with the circumferential surface of the photoconductive drum 5 before making contact with the transfer roller 9. The paper is introduced directly into the nip portion 104. Therefore, the leading edge of the introduced printing paper does not make contact with the transfer roller 9 before making contact with the photoconductive drum 5. Thus, the toner does not scatter as described above.

Figure 4:
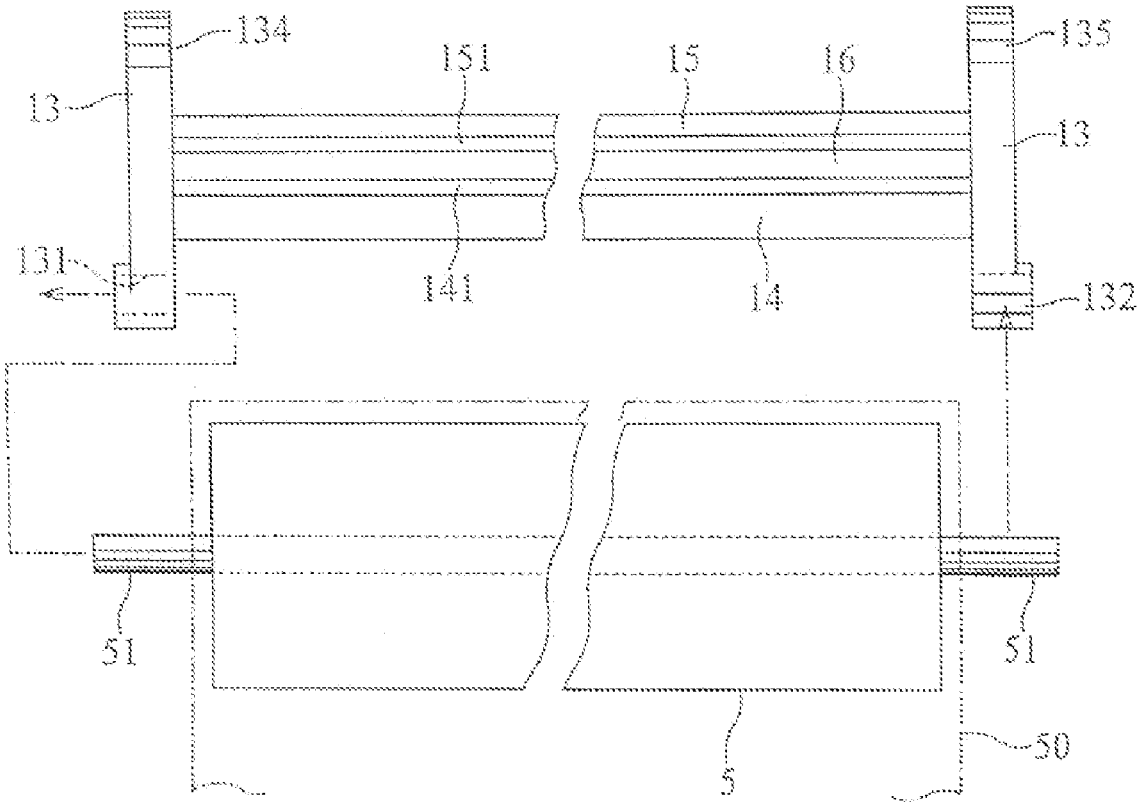
FIG. 4 is an exploded plan view illustrating a supporting relationship between the photoconductive drum and the guide supporting brackets.

A shaft hole 131 is provided through one of the guide supporting brackets 13 and 13 such that the drum shaft 51 can be inserted therethrough. A semicircular bearing portion 132 is provided on the other guide supporting bracket 13. Therefore, as illustrated in FIG. 4, one end portion of the drum shaft 51 is inserted through the shaft hole 131, and the other end portion of the drum shaft 51 is fit into the bearing portion 132. Thus, the guide supporting brackets 13 and 13 are supported on the drum shaft 51 of the photoconductive drum 5 in a manner capable of being swung.

Figure 2:
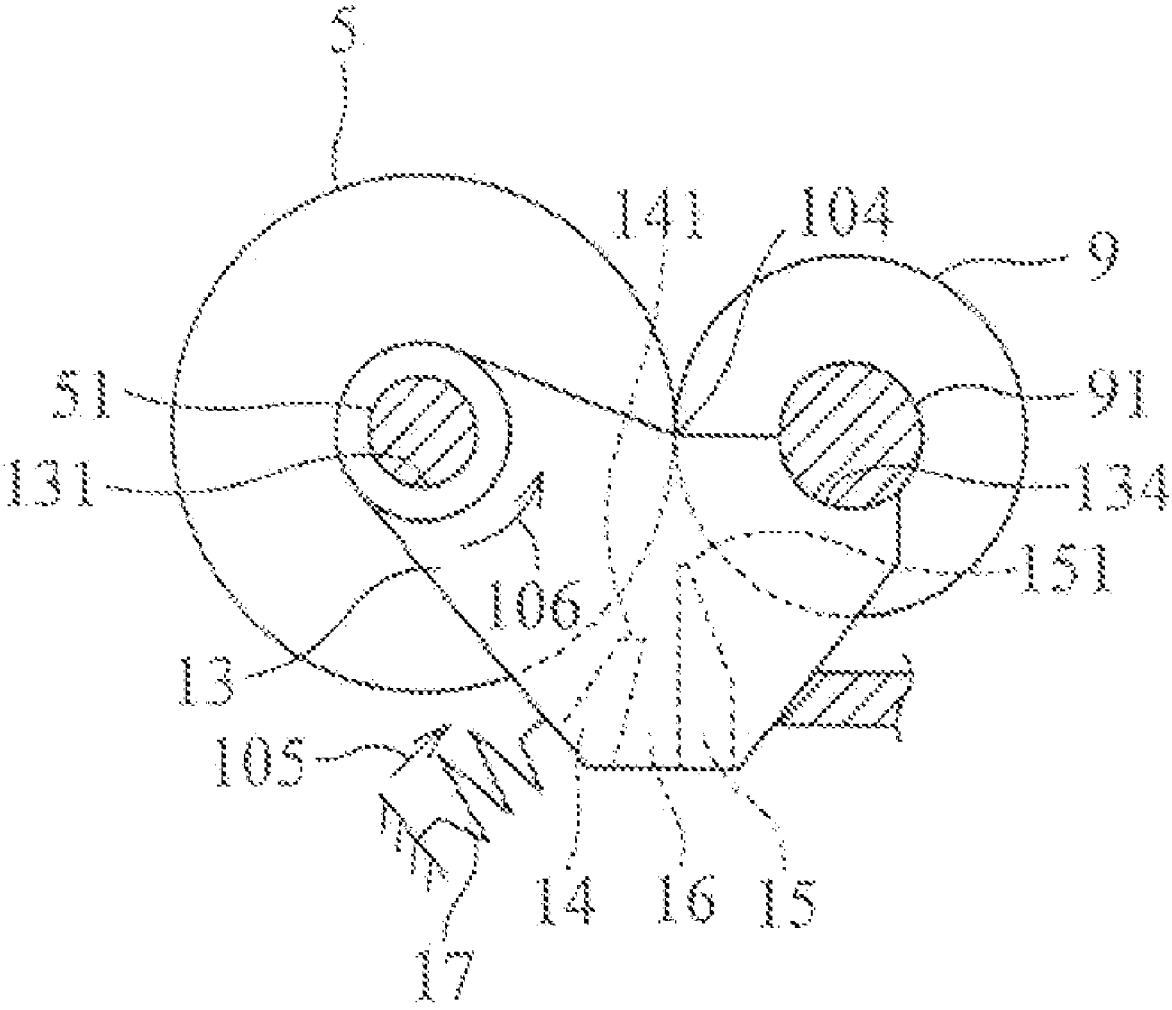
FIG. 2 is a front view schematically illustrating a relationship of a photoconductive drum and a transfer roller with respect to a guide supporting bracket.
Figure 3:
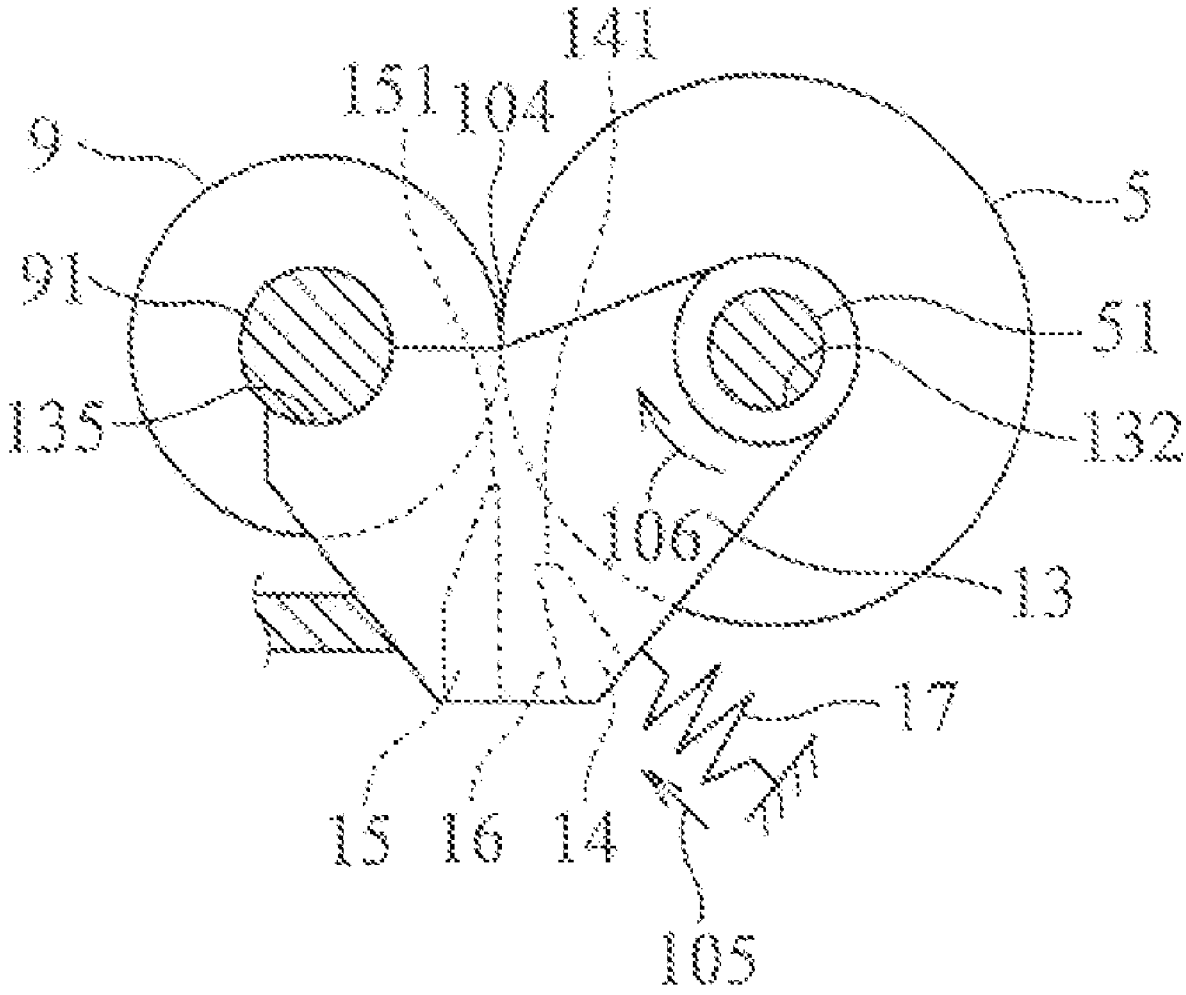
FIG. 3 is a rear view schematically illustrating a relationship of the photoconductive drum and the transfer roller with respect to the guide supporting bracket.

Semicircular contact portions 134 and 135 are respectively provided on a swinging end of the guide supporting brackets 13 and 13. The contact portions 134 and 135 are pressed against a shaft 91 of the transfer roller 9. In the drawings, the contact portions 134 and 135 are pressed directly against the shaft 91 of the transfer roller 9. The present invention is not limited to this example. For example, the contact portions 134 and 135 may be pressed against the shaft 91 of the transfer roller 9 via a bearing (not illustrated). A pair of urging members 17 and 17 are arranged on the apparatus main body 1. When the photoconductive drum 5, in other words, the drum unit 50, is positioned at a predetermined position in the apparatus main body 1, as illustrated in FIG. 2 and FIG. 3, the guide supporting brackets 13 and 13 swing in a direction indicated by an arrow 106 about the drum shaft 51 as a center by an urging force of the urging members 17 and 17 in a direction indicated by an arrow 105. Therefore, the contact portions 134 and 135 are pressed against the shaft 91 of the transfer roller 9, and the guide supporting brackets 13 and 13 are positioned. Stopping portions 18 are arranged on a chassis (not illustrated) of the apparatus main body 1. When positioning the guide supporting brackets 13 and 13 by the swinging movement, a swinging side of the guide supporting brackets 13 and 13 are pressed against the stopping portions 18. Accordingly, the guide supporting brackets 13 and 13 are positioned more reliably.

The two paper transportation guide plates 14 and 15, which are arranged laterally at a predetermined interval between the guide supporting brackets 13 and 13, are reliably set at a predetermined position in proximity of an upstream side of the nip portion 104. In addition, since the guide supporting brackets 13 and 13 are positioned directly with respect to the drum shaft 51 and the transfer roller shaft 91, the positioning is carried out with an extremely high precision. Furthermore, the positioned state is maintained precisely. The introduction of the printing paper into the nip portion 104 in synchronism with the toner image formed on the surface of the photoconductive drum 5 is carried out extremely accurately. Thus, a high quality image can be provided.

Figure 5:
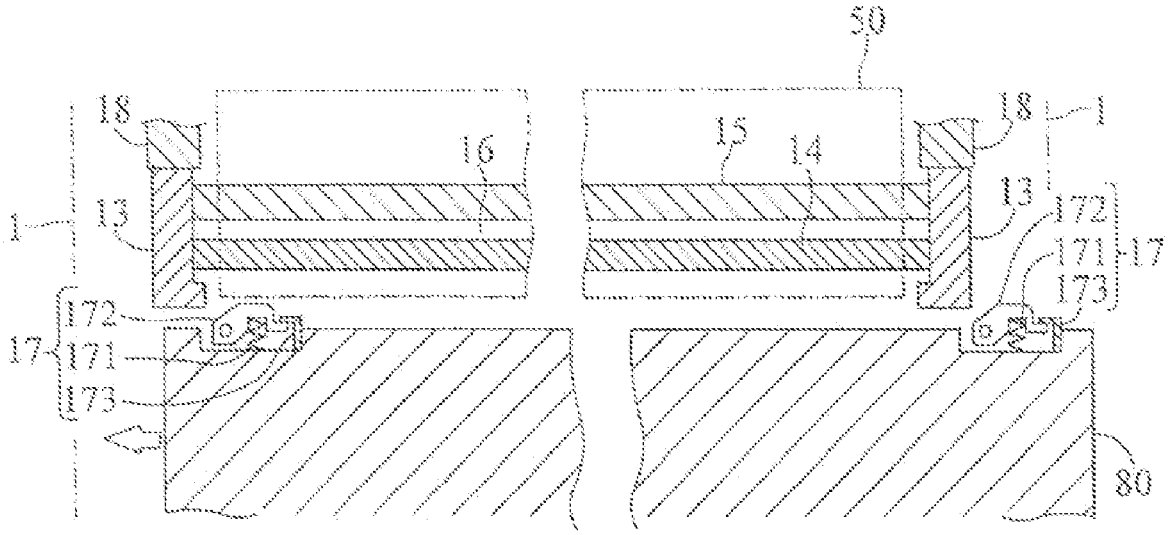
FIG. 5 is a lateral sectional view illustrating a positioning method of the guide supporting brackets, and in particular, illustrates a state before positioning.

FIG. 5 illustrates an example of the urging members 17. A compression coil spring 171, a swinging element 172, and a stopper 173 are respectively arranged on an outer surface of the developing unit 80 at two positions in a longitudinal direction. Each swinging element 172 is elastically urged outward of the developing unit 80. Each urging member 17 includes the compression coil spring 171, the swinging element 172, and the stopper 173. In the present preferred embodiment, the drum unit 50 and the developing unit 80 are capable of being inserted and removed with respect to the apparatus main body 1 in a direction perpendicular to the page of FIG. 1. After the drum unit 50 has been installed at a predetermined position in the apparatus main body 1, when the developing unit 80 is slid parallel with respect to the drum unit 50 as indicated by an outlined arrow in FIG. 5, the developing unit 80 is installed at the predetermined position. Since the swinging elements 172 and 172 are elastically urged outward, when the developing unit 80 slides, the swinging elements 172 and 172 respectively hit a side of the guide supporting brackets 13 and 13. Furthermore, when the developing unit 80 slides, the swinging elements 172 and 172 are pushed downward against an elastic force of the compression coil springs 171 and 171. When the developing unit 80 is installed at the predetermined position, in a state in which the compression coil springs 171 and 171 are compressed, the swinging elements 172 and 172 elastically make contact with the side of the guide supporting brackets 13 and 13.

Figure 6:
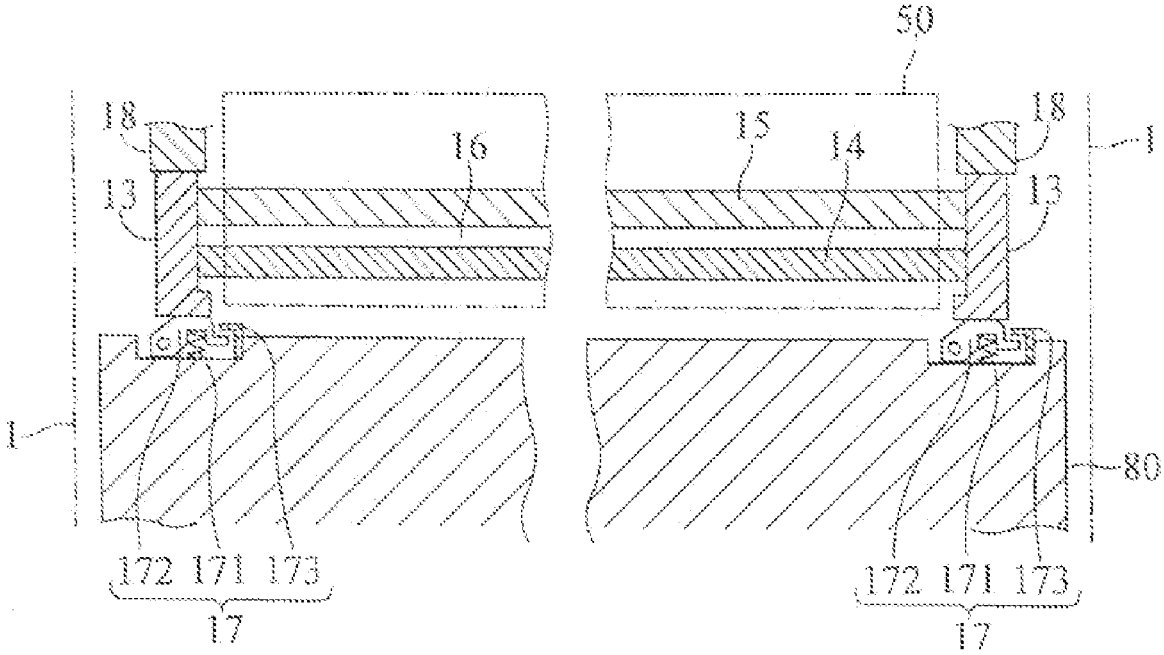
FIG. 6 is a lateral sectional view illustrating a positioning method of the guide supporting brackets, and in particular, illustrates a state after the positioning.

In a state in which the swinging elements 172 and 172 elastically make contact with the side of the guide supporting brackets 13 and 13, the guide supporting brackets 13 and 13 are urged towards the transfer roller 9 as illustrated in FIG. 2 and FIG. 3 by an elastic restoration force of the compression coil springs 171 and 171. Then, the contact portions 134 and 135 are pressed against the transfer roller shaft 91, and the swinging side of the guide supporting brackets 13 and 13 are respectively pressed against the stopping portions 18 and 18. As a result, the guide supporting brackets 13 and 13 are positioned. The positioning is carried out stably as described above and directly with respect to the drum shaft 51 of the photoconductive drum 5 and the shaft 91 of the transfer roller 9. Therefore, the paper transportation guide plates 14 and 15 are reliably set at a predetermined position and such a state is maintained. When performing maintenance work or replacing the drum unit 50 or the developing unit 80, first, the developing unit 80 is removed from the apparatus main body 1. Then, by removing the drum unit 50, the urging force is released. As a result, the drum unit 50 and the developing unit 80 can be removed easily. FIG. 5 and FIG. 6 illustrate an example in which the urging members 17 are arranged on the developing unit 80. However, the urging members 17 maybe arranged on a frame or a chassis or the like of the apparatus main body 1.

Further, in the above-described preferred embodiment, the image forming apparatus 101 is preferably a printer including a single cassette. However, the image forming apparatus 101 may be a printer including a plurality of cassettes. Furthermore, an optional cassette or the like may be stacked below the paper feed cassette 21 in FIG. 1. The present invention is not limited to a duplex printer. The present invention is also applicable to a simplex printer and a printer including a manual feeding unit. The urging members 17 are not limited to the example illustrated in the drawings. The urging members 17 may utilize another structure if the urging members 17 act on the guide supporting brackets 13 and 13 in a state in which the photoconductive drum 5 is set in the apparatus main body 1 such that the guide supporting brackets 13 and 13 are urged towards the transfer roller 9.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. An image forming apparatus comprising:

an apparatus main body;

a photoconductive drum including a drum shaft, the photoconductive drum arranged removably in the apparatus main body;

a transfer roller arranged to contact the photoconductive drum to define a nip portion and transfer a toner image on a surface of the photoconductive drum onto paper introduced into the nip portion;

a pair of guide supporting brackets including two paper transportation guides, the pair of guide supporting brackets respectively mounted on end portions of the drum shaft so as to be capable of being swung about the drum shaft as a center, and the two paper transportation guides are arranged with a predetermined interval therebetween on the pair of the guide supporting brackets; and an urging member arranged in the apparatus main body such that, in a state in which the photoconductive drum is installed in the apparatus main body, swinging ends of the guide supporting brackets are pressed against the transfer roller by the urging member and the two paper transportation guides are positioned at a predetermined position in proximity of an upstream side of the nip portion in a paper transportation direction.

2. The image forming apparatus according to claim 1, wherein the swinging ends of the pair of the guide supporting brackets are pressed against a stopping portion in the apparatus main body in the state in which the photoconductive drum is installed in the apparatus main body.

3. The image forming apparatus according to claim 1, wherein, in the paper transportation direction, a downstream end portion of the paper transportation guide closer to the transfer roller is located at a position closer to the nip portion than a downstream end portion of the paper transportation guide closer to the photoconductive drum.

4. The image forming apparatus according to claim 1, wherein the photoconductive drum is mounted in a drum casing, the photoconductive drum and the drum casing defining a drum unit.

5. The image forming apparatus according to claim 4, wherein the end portions of the drum shaft protrude from both sides of the drum casing, and the pair of the guide supporting brackets are mounted on the end portions of the drum shaft so as to be capable of being swung about the drum shaft as a center.

6. The image forming apparatus according to claim 1, wherein the swinging ends of the guide supporting brackets are pressed directly against a shaft of the transfer roller by the urging member.

7. The image forming apparatus according to claim 1, wherein the urging member includes a compression coil spring and a swinging element, and in a state in which the compression coil is compressed, the swinging element elastically makes contact with a side of the guide supporting brackets, and the guide supporting brackets are urged towards the transfer roller by an elastic force of the compression coil spring.

8. The image forming apparatus according to claim 7, further comprising a developing unit arranged removably in the apparatus main body, the developing unit developing an electrostatic latent image on the photoconductive drum, wherein the urging member is arranged on an outer surface of the developing unit at two positions in a longitudinal direction of the developing unit.

9. The image forming apparatus according to claim 8, wherein the developing unit is arranged in parallel with the drum unit when installed at a predetermined position in the apparatus main body, the swinging element is arranged to contact the side of the guide supporting brackets and is arranged to be pushed downward against the elastic force of the compression coil spring during installation of the developing unit, and the swinging element elastically makes contact with the side of the guide supporting brackets when the compression coil spring is compressed after installation of the developing unit at the predetermined position.

10. The image forming apparatus according to claim 9, wherein the urging member is arranged such that the elastic force of the urging member is released when the developing unit is removed from the apparatus main body.

11. An apparatus main body comprising:

an installation section including a drum unit, the drum unit including a photoconductive drum, two paper transportation guides, and a pair of guide supporting brackets mounted on end portions of a drum shaft of the photoconductive drum so as to be capable of being swung about the drum shaft as a center, wherein the two paper transportation guides are arranged with a predetermined interval therebetween on the pair of the guide supporting brackets;

a transfer roller arranged to contact the photoconductive drum to define a nip portion and transfer a toner image on a surface of the photoconductive drum onto paper introduced into the nip portion; and an urging member arranged in the apparatus main body such that, in a state in which the photoconductive drum is installed in the apparatus main body, swinging ends of the guide supporting brackets are pressed against the transfer roller by the urging member and the two paper transportation guides are positioned at a predetermined position in proximity of an upstream side of the nip portion in a paper transportation direction.

12. The apparatus main body according to claim 11, wherein the urging member includes a compression coil spring and a swinging element, and in a state in which the compression coil is compressed, the swinging element elastically makes contact with a side of the guide supporting brackets, and the guide supporting brackets are urged towards the transfer roller by an elastic force of the compression coil spring.

13. The apparatus main body according to claim 11, wherein the urging member directly presses the swinging ends of the guide supporting brackets against a shaft of the transfer roller.

14. The apparatus main body according to claim 12, further comprising an installation section arranged to receive a developing unit which develops an electrostatic latent image on the photoconductive drum, wherein the urging member is arranged on an outer surface of the developing unit at two positions in a longitudinal direction of the developing unit.

15. The apparatus main body according to claim 14, wherein the developing unit is arranged in parallel with the drum unit when installed at a predetermined position in the apparatus main body, the swinging element is arranged to contact the side of the guide supporting brackets and is arranged to be pushed downward against the elastic force of the compression coil spring during installation of the developing unit, and the swinging element elastically makes contact with the side of the guide supporting brackets when the compression coil spring is compressed after installation of the developing unit at the predetermined position.

16. The apparatus main body according to claim 15, wherein the urging member is arranged such that the elastic force of the urging member is released when the developing unit is removed from the apparatus main body.

* * * * *